US005421795A

United States Patent [19]

Chen

[11] Patent Number: 5,421,795

[45] Date of Patent: Jun. 6, 1995

[54] HORSE-RIDING TYPE EXERCISER

[76] Inventor: Paul Chen, No. 3-6, Ching Yang Road, Liu Pao Village, Ta Ya Hsiang, Taichung Hsien, Taiwan, Prov. of China

[21] Appl. No.: 336,775

[22] Filed: Nov. 9, 1994

[51] Int. Cl.[6] ..... A63B 69/06; A63B 21/068

[52] U.S. Cl. ..... 482/96; 482/72

[58] Field of Search ..... 482/95, 96, 51, 72, 482/57, 111, 148; 472/106, 110

[56] References Cited

U.S. PATENT DOCUMENTS

| | | | |
|---|---|---|---|
| 2,455,548 | 12/1948 | Bell | 482/96 |
| 4,300,760 | 11/1981 | Bobroff | 482/96 |
| 5,299,997 | 4/1994 | Chen | 482/96 |

FOREIGN PATENT DOCUMENTS

| | | | |
|---|---|---|---|
| 0495304 | 8/1953 | Canada | 482/96 |

*Primary Examiner*—Stephen R. Crow

*Attorney, Agent, or Firm*—Charles E. Baxley

[57] ABSTRACT

An exerciser includes a lever having a rear and lower portion slidably engaged in the base and a front and upper portion for supporting a handle. A seat post includes an intermediate portion having a front and lower portion pivotally coupled to the base and having a rear and upper portion pivotally coupled to the lever. A foot pedal is secured to the front portion of the seat post for rotating the lever and the seat post relative to each other so as to simulate horse-riding actions. The foot pedal is solidly secured to the seat post without further link members.

4 Claims, 3 Drawing Sheets

HORSE-RIDING TYPE EXERCISER

BACKGROUND OF THE INVENTION

1. Field of the Invention

The present invention relates to an exerciser, and more particularly to a horse-riding type exerciser.

2. Description of the Prior Art

The closest prior art of which applicant is aware is his prior U.S. Pat. No. 5,299,997 to Chen, issued Apr. 5, 1994. The foot rests are required to be coupled to the seat post and the support means by a seat post and a pivotal beam. The exerciser includes a relatively complicated configuration.

The present invention has arisen to mitigate and/or obviate the afore-described disadvantages of the conventional exercisers.

SUMMARY OF THE INVENTION

The primary objective of the present invention is to provide a horse-riding type exerciser which includes a simplified configuration.

In accordance with one aspect of the invention, there is provided an exerciser comprising a base including a front portion and a rear portion, track means provided longitudinally in the rear portion of the base, means for sliding engagement in the track means, a lever means including a rear and lower portion pivotally coupled to the sliding means so as to be movable along the track means, and including a front and upper portion for supporting handle means thereon, and a seat post means including a front portion, an intermediate port ion and a rear port ion, the intermediate portion including a front and lower portion pivotally coupled to the front portion of the base at a first pivot axle and including a rear and upper portion pivotally coupled to the lever means at a second pivot axle, the front portion of the seat post means being bent upward for supporting foot pedal means, and the rear portion of the seat post means including a seat cushion means provided thereon. The seat post means is rotated relative to the first pivot axle, the lever means is rotated relative to the seat post means and the sliding means is slidably moving along the track means so as to simulate horse-riding actions.

The track means includes a rod supported above the rear portion of the base and arranged in parallel to the base so as to form the track means between the rod and the base. The sliding means includes a roller rotatably and movably engaged in the track means. The base includes a longitudinal beam, the roller includes two side discs for engaging with the longitudinal beam so as to retain the roller in place.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
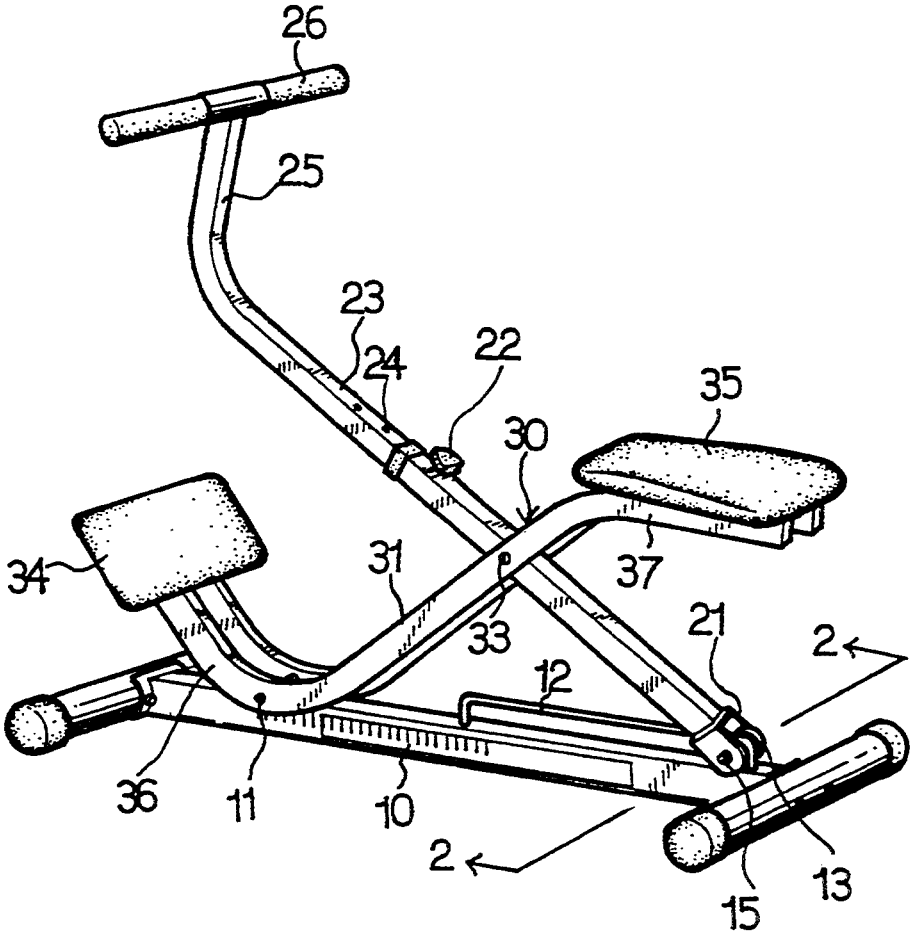
FIG. 1 is a perspective view of a horse-riding type exerciser in accordance with the present invention.
Figure 2:
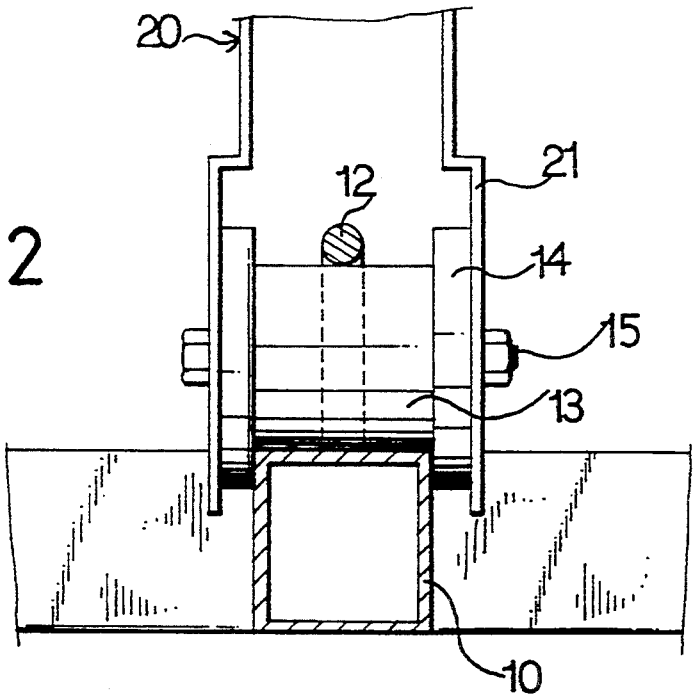
FIG. 2 is a cross sectional view taken along lines 2—2 of FIG.
Figure 3:
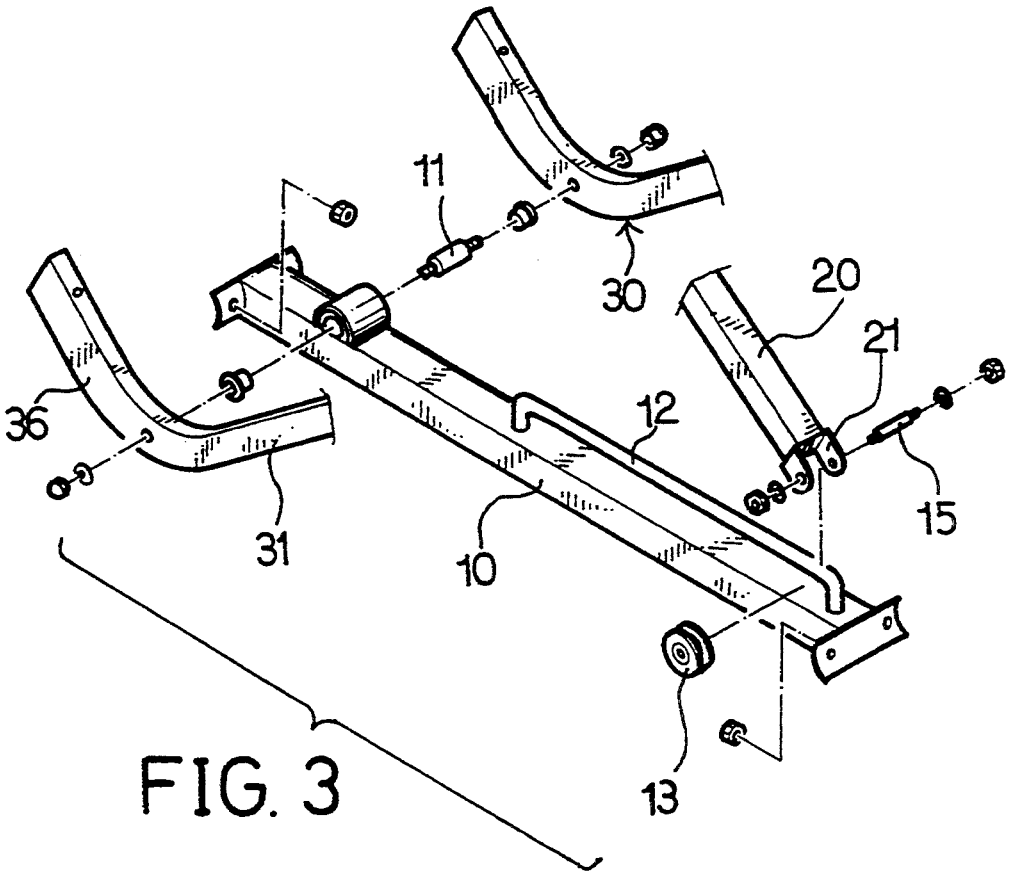
FIG. 3 is a partial exploded view illustrating the lower portion of the horse-riding type exerciser.

Referring to the drawings, and initially to FIGS. 1 to 3, a horse-riding type exerciser in accordance with the present invention comprises a base including a longitudinal beam having a pivot pin laterally provided in the front portion thereof and a rod 12 disposed above the rear portion of the beam 10 and extended in parallel to the beam 10 so as to form a track 10, 12 between the beam 10 and the rod 12. A roller 13 is rotatably and movably engaged in the track 10, 12 and preferably includes two side discs 14 for engaging with the beam 10, best shown in FIG. 2, so as to allow smooth moving of the roller 13 in the track. The roller 13 includes a pivot pin 15 provided in the center portion thereof.

A lever 20 includes a pair of lugs 21 provided in the rear and lower end for pivotally coupling to the roller 13 at the pivot pin 15 such that the rear end of the lever 20 may move longitudinally along the track 10, 12. The lever 20 includes a bolt means 22 provided in the upper front end thereof. A bar 23 is slidably engaged in the upper front end of the lever 20 and includes a number of holes 24 for engaging with the bolt means 22 such that the bar 23 may be adjusted relative to the lever 20, and includes a post 25 extended upward therefrom for supporting a handle 26.

A seat post 30 includes a pair of parallel sticks having an intermediate portion 31, a front portion 36 and a rear portion 37. The intermediate portion includes a front and lower portion pivotally coupled to the base 10 as the pivot pin 11 such that the seat post 30 may be rotated relative to the base 10 at the pivot pin 11, and includes a rear and upper portion pivotally coupled to the lever 20 at a pivot pin 33 such that the seat post 30 may be rotated relative to the lever 20 at the pivot pin 33. The front portion 36 is bent upward relative to the intermediate portion 31 for supporting a foot pedal 34. The rear portion 37 is bent downward relative to the intermediate portion 31 for supporting a seat cushion 35 thereon. It is to be noted that the foot pedal 34 is directly secured to the front end of the seat post and does not need to be coupled to the seat post by additional link members.

Figure 4:
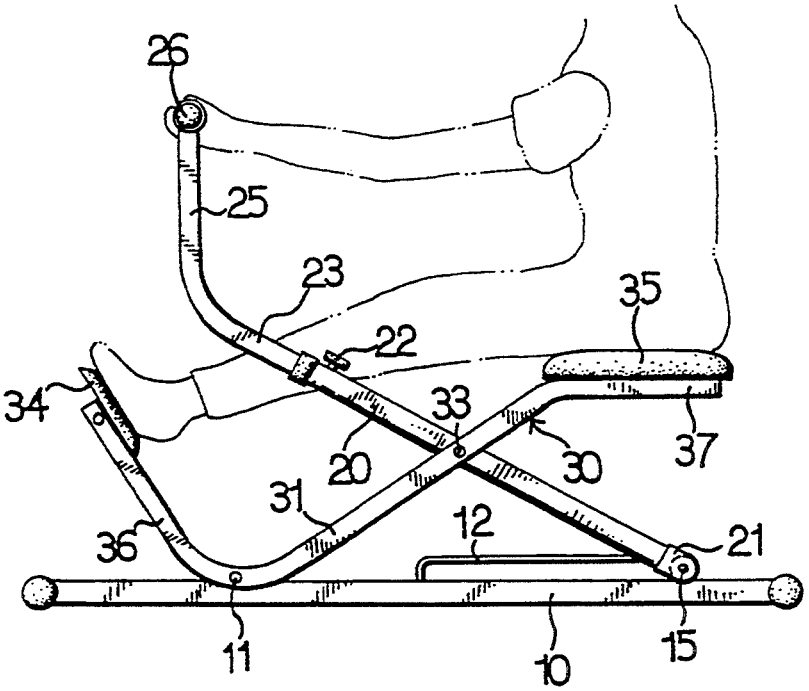
FIGS. 4 and 5 are plane views illustrating the operation of the horse-riding type exerciser.
Figure 5:
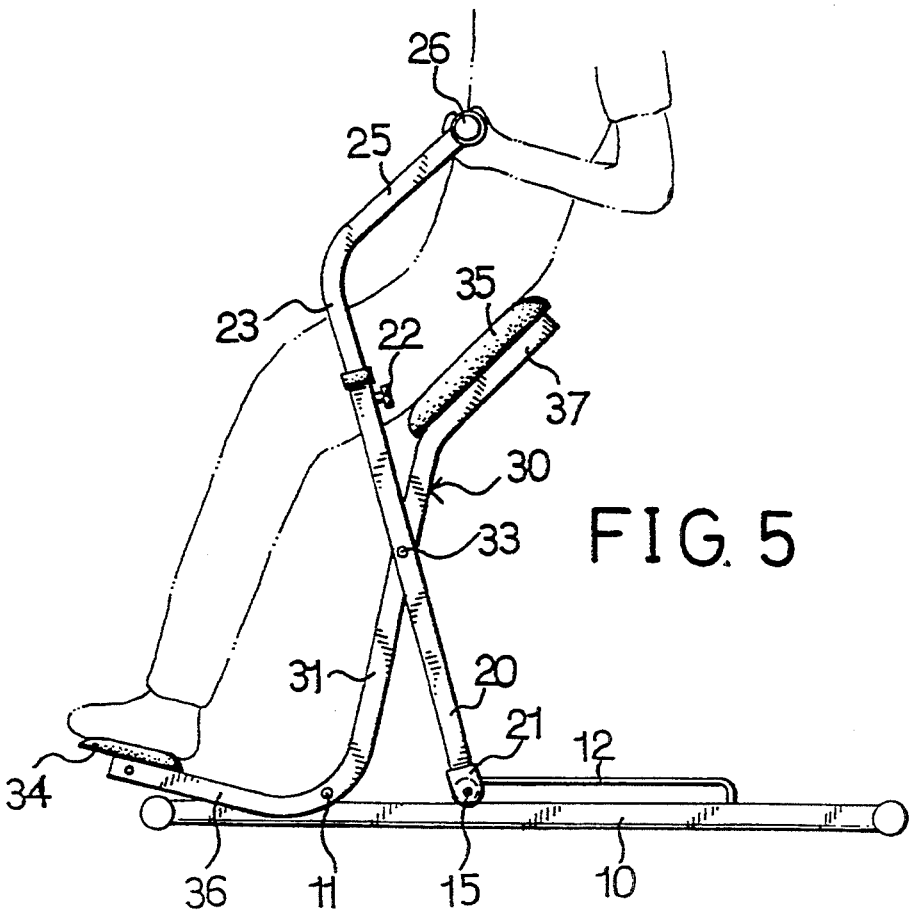

Referring next to FIG. 4, in operation, the users may apply a force against the foot pedal 34 for rotating the seat post 30 counterclockwise and/or may apply a pulling force to the handle 26 for rotating the lever 20 clockwise, such that the roller 13 may be caused to move along the track 10, 12 and such that the pivot pin 33 and the seat cushion 35 may be caused to move upward for simulating horse-riding action, as shown in FIG. 5. When the force applied to the foot pedal 34 and/or the handle 26 is released, the foot pedal 34 may move upward and the seat cushion 35 may move downward to the rest position as shown in FIG. 4.

Accordingly, the horse-riding exerciser in accordance with the present invention includes a simplified configuration. The front portion 36 to which the foot pedal 34 is secured may be solidly secured to the seat post 31. No other link members are required for coupling the foot pedal 34 to the seat post 31.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a front portion and a rear portion, track means provided longitudinally in said rear portion of said base, means for sliding engagement in said track means, a lever means including a rear and lower portion pivotally coupled to said sliding means so as to be movable along said track means, and including a front and upper portion for supporting handle means thereon, and a seat post means including a front portion, an intermediate portion and a rear portion, said intermediate portion including a front and lower portion pivotally coupled to said front portion of said base at a first pivot axle and including a rear and upper portion pivotally coupled to said lever means at a second pivot axle, said front portion of said seat post means being bent relative to said intermediate portion for supporting foot pedal means, and said rear portion of said seat post means being provided for supporting a seat cushion means thereon, said seat post means being rotated relative to said first pivot axle, said lever means being rotated relative to said seat post means and said sliding means being slidably moving along said track means so as to simulate horse-riding actions.

2. An exerciser according to claim 1, wherein said track means includes a rod supported above said rear portion of said base and arranged in parallel to said base so as to form said track means between said rod and said base.

3. An exerciser according to claim 1, wherein said sliding means includes a roller rotatably and movably engaged in said track means.

4. An exerciser according to claim 3, wherein said base includes a longitudinal beam, said roller includes two side discs for engaging with said longitudinal beam so as to retain said roller in place.

* * * * *